US008678852B2

(12) United States Patent
Rineau et al.

(10) Patent No.: US 8,678,852 B2
(45) Date of Patent: Mar. 25, 2014

(54) CONNECTOR FOR CONNECTING TWO ELECTRIC CABLES TOGETHER

(75) Inventors: Vivien Rineau, Lubersac (FR); Jean-Luc Lagarde, Malemort (FR)

(73) Assignee: Societe Industrielle de Construction d'Appareils et de Materiel Electriques, Arnac Pompadour (FR)

( * ) Notice: Subject to any disclaimer, the term of this patent is extended or adjusted under 35 U.S.C. 154(b) by 71 days.

(21) Appl. No.: 13/534,715

(22) Filed: Jun. 27, 2012

(65) Prior Publication Data

US 2013/0005175 A1 Jan. 3, 2013

(30) Foreign Application Priority Data

Jun. 28, 2011 (FR) ..... 11 55780

(51) Int. Cl.
*H01R 4/24* (2006.01)

(52) U.S. Cl.
USPC ..... 439/402; 439/417

(58) Field of Classification Search
USPC ..... 439/402, 417, 403
See application file for complete search history.

(56) References Cited

U.S. PATENT DOCUMENTS

| | | | | |
|---|---|---|---|---|
| 4,074,608 | A | 2/1978 | Siebol | |
| 4,602,840 | A * | 7/1986 | Romatzick | 439/416 |
| 4,904,133 | A | 2/1990 | Wright | |
| 5,453,001 | A * | 9/1995 | Huang | 425/535 |
| 6,086,406 | A * | 7/2000 | Francois et al. | 439/402 |
| 6,264,492 | B1 * | 7/2001 | LaLaouna et al. | 439/402 |
| 6,315,595 | B1 * | 11/2001 | LaPorte et al. | 439/412 |
| 6,604,956 | B2 * | 8/2003 | Ruiz et al. | 439/409 |
| 2005/0164565 | A1 | 7/2005 | Fricchione | |
| 2005/0227529 | A1 * | 10/2005 | Mrakovich et al. | 439/402 |
| 2008/0170926 | A1 | 7/2008 | Taylor | |

FOREIGN PATENT DOCUMENTS

| | | |
|---|---|---|
| EP | 0 497 455 | 8/1992 |
| EP | 0 586 283 | 3/1994 |
| FR | 2 760 570 | 9/1998 |
| FR | 2 819 943 | 7/2002 |

OTHER PUBLICATIONS

French search report dated Dec. 8, 2011 in corresponding FR 1155780.

* cited by examiner

*Primary Examiner* — Gary Paumen

(74) *Attorney, Agent, or Firm* — Young & Thompson

(57) ABSTRACT

A connector configured to adopt a position for the installation of cables between jaws (2*a*, 2*b*), to adopt an in-service position in which the cables are sandwiched between the jaws (2*a*, 2*b*) and to pass from the cable installation position to the in-service position by bringing the jaws (2*a*, 2*b*) closer together, with a tightening element that is a blind rivet (4).

12 Claims, 4 Drawing Sheets

CONNECTOR FOR CONNECTING TWO ELECTRIC CABLES TOGETHER

The invention relates to connectors for connecting two electric cables together.

There is already known, in particular from French patent application 2 762 449, such a connector for connecting two electric cables together, typically cables formed by a conductive core and an insulating sheath, such a connector making both an electrical connection and a mechanical connection of the two cables.

The connector described by this document comprises: two jaws and a screw/nut pair for bringing said jaws closer together, each said jaw comprising a body made of stiff insulating material and a conductive contact element having two active parts each projecting from a receiving face of the body in order to penetrate the conductive core of one cable and the conductive core of the other cable respectively, each receiving face of the body of each jaw facing the receiving face of the body of the other jaw with each active part of the contact element of one jaw in line with an active part of the contact element of the other jaw, said connector allowing a cable installation position between the receiving faces of the jaws with each active part of a contact element in line with one cable and allowing an in-service position in which the cables are sandwiched between the jaws with each active part having penetrated a conductive core of a respective cable, said connector being configured to pass from the cable installation position to the in-service position by bringing the jaws closer together, with the screw/nut pair, by a predetermined stroke.

There is also known, in particular from French patent application 2 760 570, a similar connector in which the screw of the screw/nut pair has a shearable head designed to break when a predetermined tightening torque is reached. This avoids cutting the cables by tightening the jaws too tightly against each other. It also provides some degree of tamper-proofness to the connector when in place.

The invention aims to provide a similar connector that is simple, convenient and economic.

To this end the invention proposes a connector for connecting two electric cables together, comprising two jaws and a tightening element for bringing said jaws closer together, each said jaw comprising a body made of stiff insulating material and a conductive contact element having two active parts each projecting from a receiving face of the body in order to penetrate the conductive core of one cable and the conductive core of the other cable respectively, the receiving face of the body of each jaw facing the receiving face of the body of the other jaw with each active part of the contact element of one jaw in line with an active part of the contact element of the other jaw, said connector being configured to adopt a cable installation position between the receiving faces of the jaws with each active part of a contact element in line with a cable, to adopt an in-service position in which the cables are sandwiched between the jaws with each active part of each contact element having penetrated a conductive core of a respective cable, and to pass from the cable installation position to the in-service position by bringing the jaws closer together, with the tightening element, by a predetermined stroke;

characterized in that said tightening element is a blind rivet comprising a shank and a mandrel, said blind rivet being configured so that the shank contracts in the axial direction, under the action of the mandrel, between the cable installation position and the in-service position, and configured so that the mandrel breaks when said jaws are brought closer together by said predetermined stroke.

Thus, the tightening element of the connector according to the invention is not a screw/nut pair but a blind rivet.

When passing from the cable installation position to the in-service position, the blind rivet pulls the jaws towards each other to make them penetrate the cables.

Although it may seem surprising for a blind rivet to be capable of a function of pulling the jaws, trials carried out by the Applicant have shown that a blind rivet is capable of providing both the stroke and the force required for the jaws to penetrate the cables and to allow the mandrel to break precisely when the required penetration depth into the cables has been reached.

It will be noted furthermore that a blind rivet is particularly economic and convenient to use while providing an excellent guarantee of tamper-proofness.

According to preferred characteristics for reasons of simplicity, convenience and economy:

said shank comprises a head facing an end face of a first said jaw while said mandrel has a head on the side of the end of said shank opposite said head, with said shank comprising a body engaged in a hole in the first jaw extending from said end face to said receiving face and into a hole in said second jaw extending from said receiving face to an end face opposite the receiving face, said body emerging from said second jaw through an engagement orifice for a bead presented by said shank in said in-service position;

said engagement orifice is delimited by a reinforcing element attached to the body of said second jaw;

said reinforcing element is a metal washer engaged in the base of a countersink of said hole in said second jaw;

in said cable installation position, at least a portion of said hole in said second jaw has a diameter greater than the diameter of the body of the shank to allow said body to increase in width in said portion when passing from the cable installation position to the in-service position;

In a ready-to-use condition, the connector comprises captive means of said rivet;

said captive means are formed by a bead of said body of said shank, begun by said head of said mandrel;

said connector is configured so that said two electric cables each have a cross-section comprised between 1.5 $mm^2$ and 25 $mm^2$ with said mandrel configured to break when subjected to a tensile force comprised between 4,500 N and 6,500 N;

said connector is configured so that said two electric cables each have a cross-section comprised between 16 $mm^2$ and 95 $mm^2$ with said mandrel configured to break when subjected to a tensile force comprised between 11,000 N and 13,000 N; and/or said connector is configured so that a first one of said two electric cables has a cross-section comprised between 16 $mm^2$ and 95 $mm^2$ and the second of said two cables has a cross-section comprised between 4 $mm^2$ and 35 $mm^2$ with said mandrel configured to break when subjected to a tensile force comprised between 8,500 N and 10,500 N.

The invention will now be further disclosed via the detailed description of an embodiment, given non-limitatively by way of illustration, with reference to the attached drawings, in which.

Figure 1:
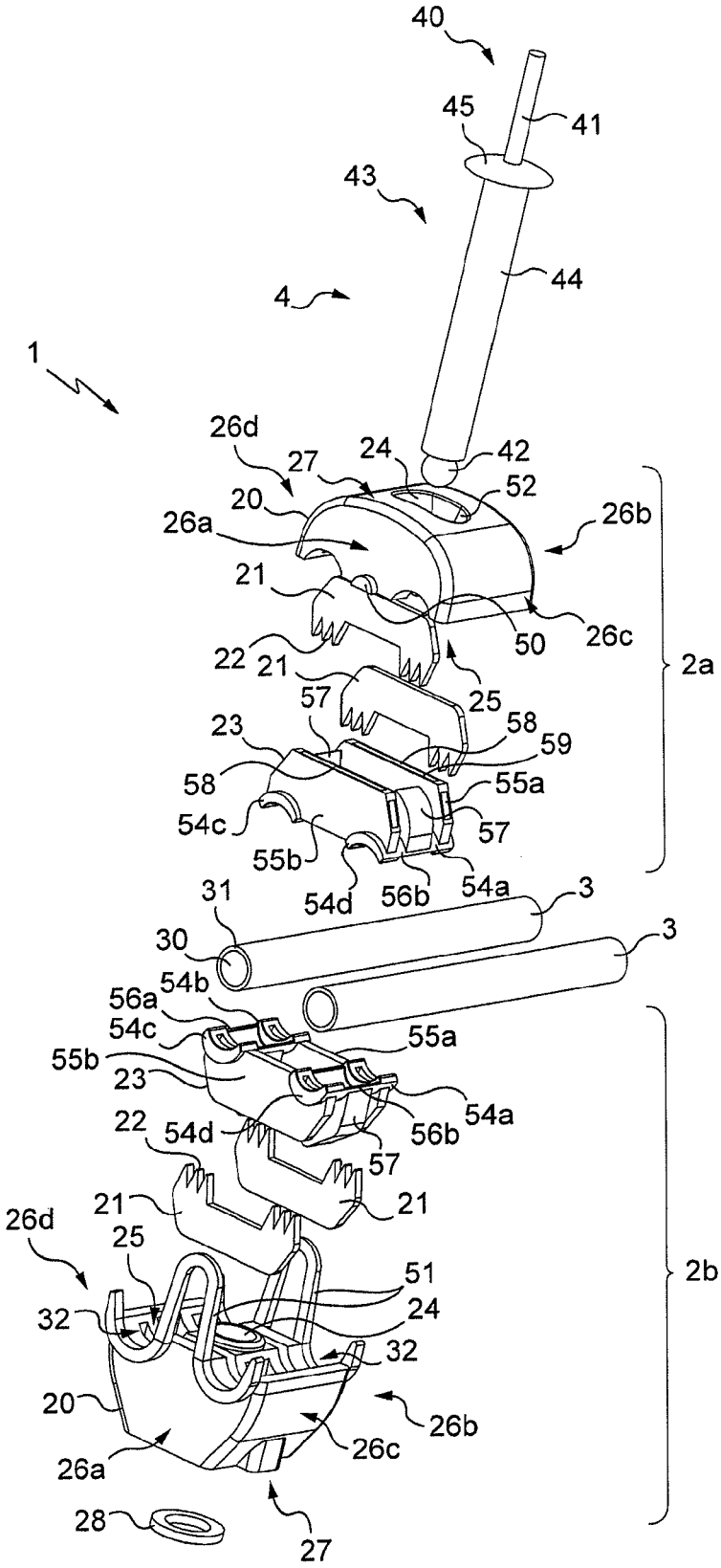
FIG. 1 is an exploded perspective view of a connector according to the invention and two cables to be connected.
Figure 3:
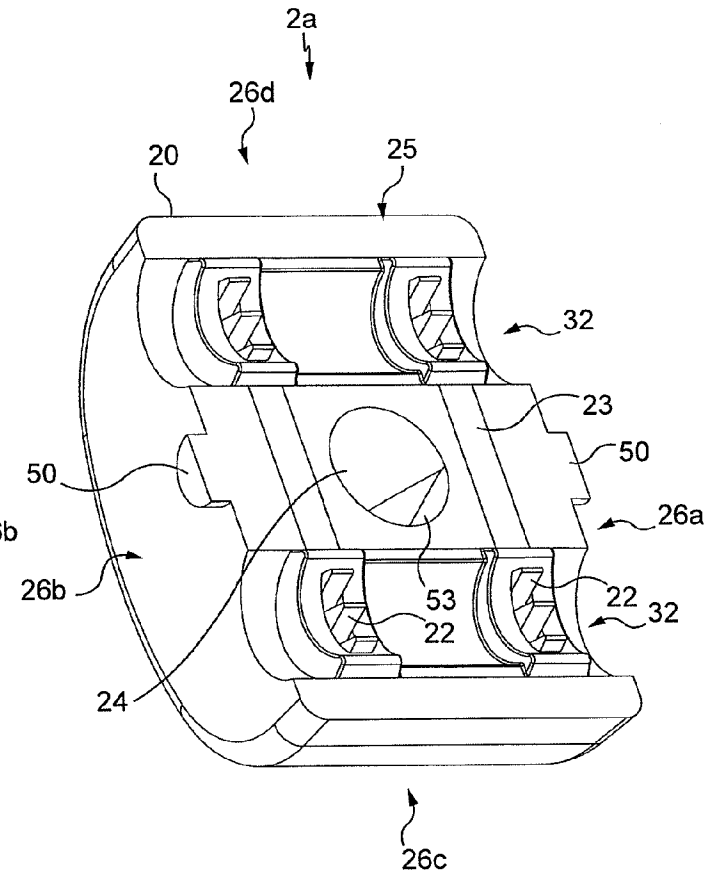
FIGS. 2 and 3 are perspective views of the jaws of the connector taken in isolation, showing their receiving face.
Figure 2:
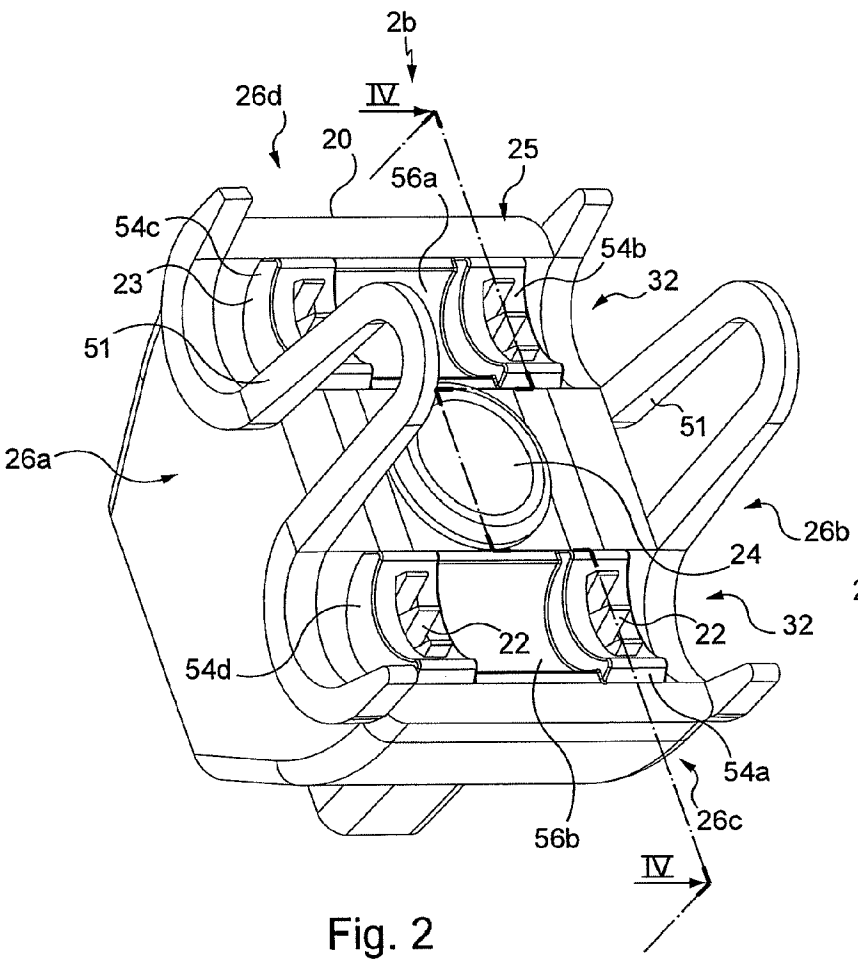

The connector 1 shown in FIGS. 1 to 5 is intended to electrically connect together two cables 3.

The connector 1 comprises a first jaw 2*a*, a second jaw 2*b* and a blind rivet 4.

Each jaw 2*a*, 2*b* comprises a body 20, two conductive contact elements 21 and a sealing gasket 23.

Each body 20 is made of stiff insulating material. It is presented in the form of a shell having a receiving face 25, an end face 27 opposite the receiving face 25 and four lateral faces 26*a*, 26*b*, 26*c*, 26*d*, each extending from the receiving face 25 to the end face 27. Among these, a first lateral face 26*a* is opposite a second lateral face 26*b*.

The receiving face 25 has two cable grooves 32 extending from the face 26*a* to the face 26*b*.

Each body 20 is traversed by a hole 24 opening on the one hand onto the end face 27 and on the other hand onto the receiving face 25, between the two cable grooves 32.

On the body 20 of the first jaw 2*a*, a lug 50 projects from each lateral face 26*a*, 26*b*. Each lug 50 is situated at the junction of the corresponding lateral face 26*a*, 26*b* with the receiving face 25, between the ends of the cable grooves 32 (see FIG. 3).

On the body 20 of the second jaw 2*b*, between the ends of the cable grooves 32, for each of the lateral faces 26*a* and 26*b*, beyond these faces, a lateral wall 51 extends in the opposite direction from the receiving face 25. Here, each wall 51 is in the shape of a stirrup, the ends of which are situated at the junction of the receiving face 25 and the corresponding lateral face 26*a* or 26*b* (see FIG. 2).

The hole 24 in the first jaw 2*a* opens onto the receiving face 25 via an orifice 53 that has a circular outline and onto the end face 27 via an orifice 52 that has an oval outline.

The hole 24 in the second jaw 2*b* has two cylindrical portions. A first portion of the hole 24 is a bore 33 opening onto the receiving face 25. The other portion of the hole 24 is a countersink 29 having a diameter greater than that of the bore 33. The countersink 29 opens onto the end face 27 via an orifice 60 that has a circular outline.

A metal washer 28 is attached to the base of the countersink 29. Here, the washer 28 is secured to the body 20 by the fact that it is press-fitted into the countersink 29. In a variant, the metal washer 28 is held by other means, for example by clipping.

Each contact element 21 is a thin U-shaped metal plate comprising a central branch and two distal branches. The distal branches each comprise an active part 22 at their end. Each active part 22 here comprises three pointed teeth arranged side by side. In a variant, the number of teeth is different from three, for example two teeth or more than three teeth.

Each sealing gasket 23 comprises two casings 55*a* and 55*b* each intended to receive one of the contact elements 21, while allowing only the active parts 22 to emerge, through an arc-shaped cradle 54*a*, 54*b*, 54*c* or 54*d* respectively.

Each casing 55*a* and 55*b* comprises two flanges side by side delimiting a median recess 58 where a contact element 21 is installed via an orifice 59 opposite the cradles 54*a* and 54*b* or 54*c* and 54*d*.

The casings 55*a* and 55*b* are linked by bridges 56*a* and 56*b* in the form of a curved tile arranged respectively between the cradles 54*b* and 54*c* and between the cradles 54*a* and 54*d*. Here, a protuberance 57 projects from each of the bridges 56*a* and 56*b* away from and facing the casings 55*a* and 55*b*. In a variant, the sealing gaskets 23 do not comprise any protuberance such as 57.

The cables 3 are here of a conventional type, each comprising a conductive core 30 and an insulating sheath 31.

Figure 4:
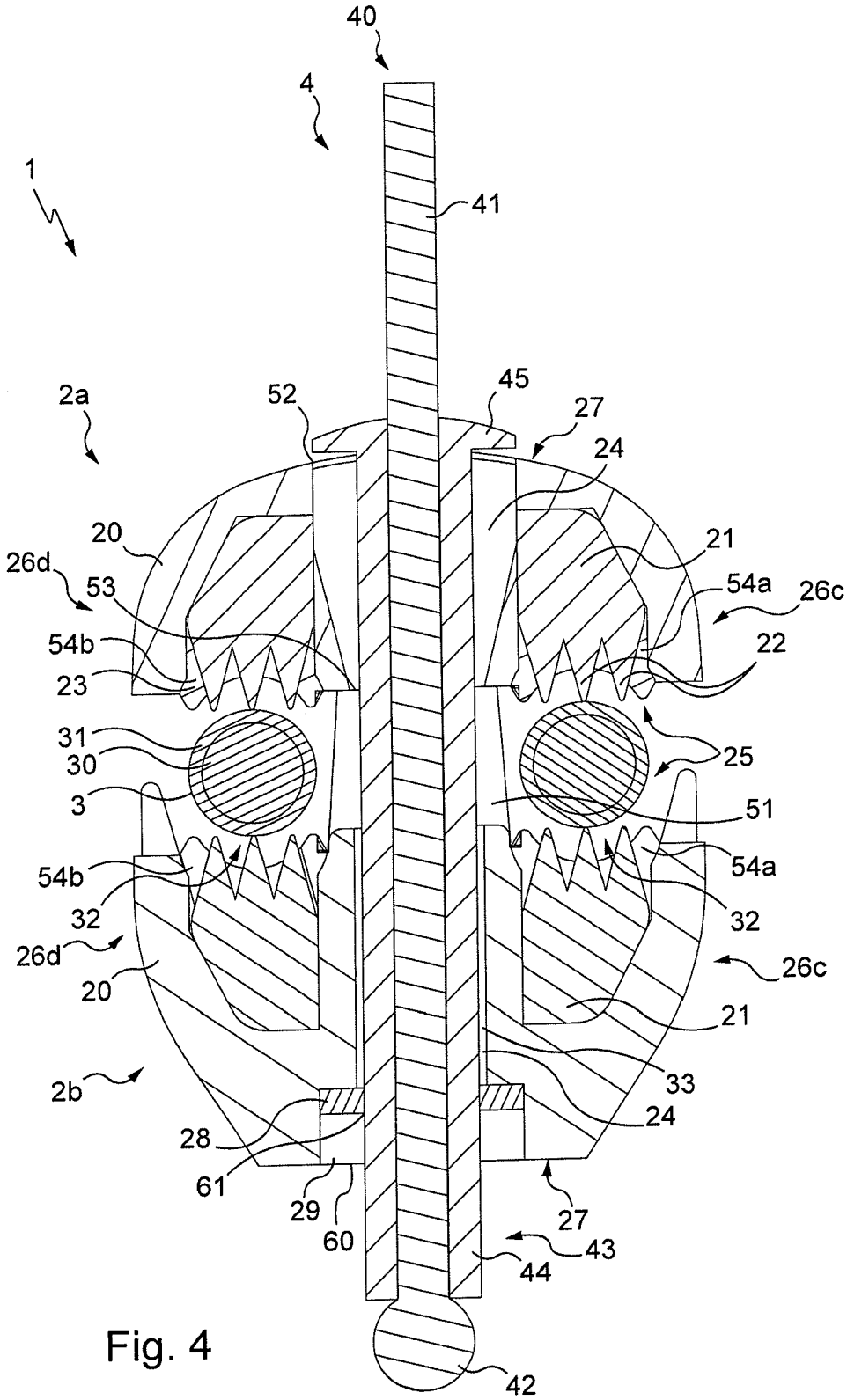
FIG. 4 is a broken view along the break plane denoted by IV-IV in FIG. 2, of the connector and the two cables to be connected in the cable installation position.
Figure 5:
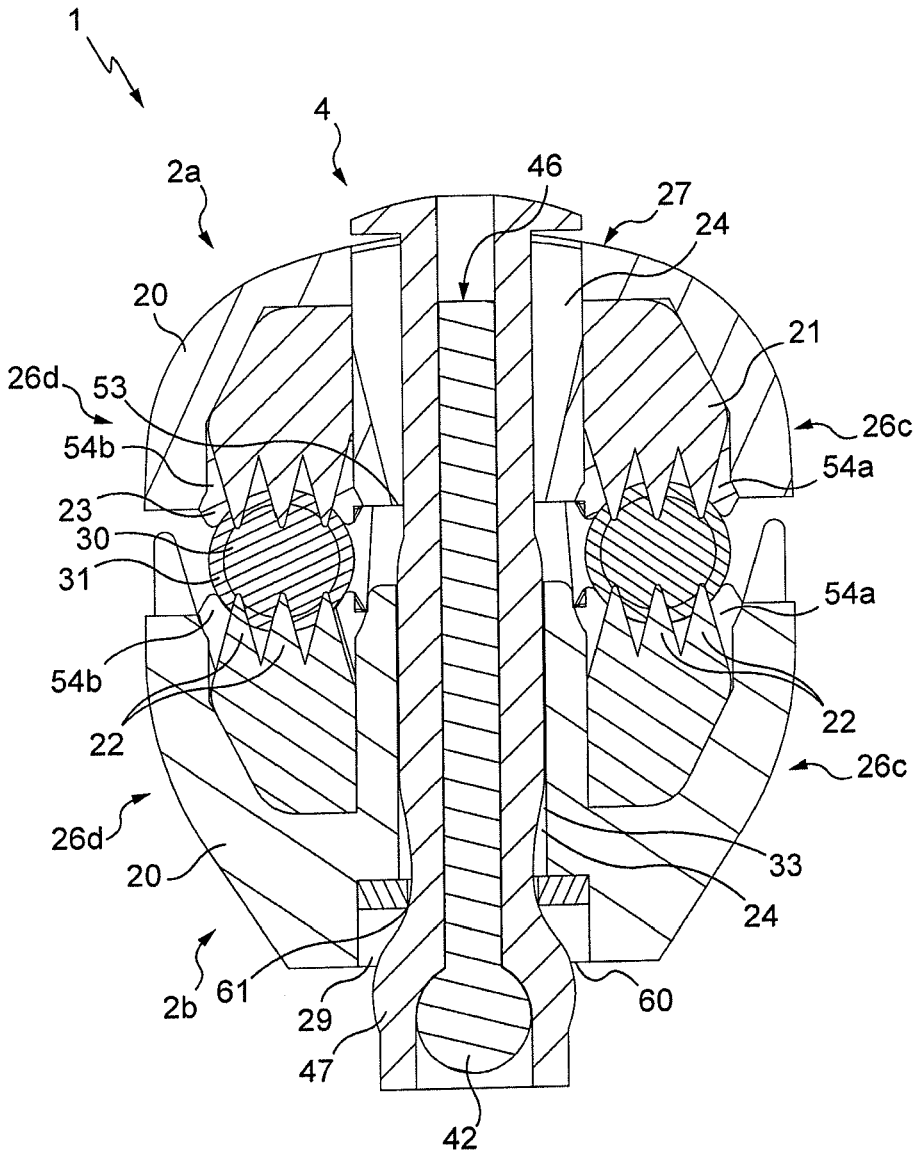
FIG. 5 is a view similar to FIG. 4, in the in-service position.

The blind rivet 4 comprises a mandrel 40 and a hollow shank 43. The mandrel 40 has a body 41 and a head 42. The shank 43 has a body 44 and a head 45. The blind rivet 4 is configured to pass from a pre-set condition (FIG. 4) to a set condition (FIG. 5).

In the pre-set condition of the blind rivet 4, the body 41 of the mandrel 40 is engaged in the body 44 of the shank 43 and extends beyond the body 44 on the side of the head 45. The head 42 of the mandrel 40 abuts the end of the body 44 opposite the head 45.

In the set condition, the head 42 is forcibly engaged in the body 44; the body 44 has a bead 47 around the head 42 and the mandrel 40 snaps at a shear zone 46.

Here, the shank 43 is made of an easily deformable metal, for example aluminium, stainless steel or annealed copper. The mandrel 40 is made of a material that is not readily deformed, for example hard steel. In order to calibrate the shear strength of the mandrel 40, the body 41 has a reduction in cross-section (not shown) that has a predetermined shape.

Assembly of the connector 1 is described hereinafter.

The sealing gaskets 23 surrounding the contact elements 21 are each press-fitted in the body 20 of the corresponding jaw 2*a* or 2*b*. Each sealing gasket 23 is complementary to a cavity in the respective body 20.

Once the jaws 2*a* and 2*b* are assembled, the cradles 54*a*, 54*b*, 54*c*, 54*d*, and therefore the active parts 22, project into the respective cable grooves 32. The curvature of the cradles 54*a*, 54*b*, 54*c*, and 54*d* follows that of the cable grooves 32.

The jaws 2*a* and 2*b* are arranged with the receiving faces 25 facing each other. Furthermore, the lugs 50 come to lodge in the stirrups 51, holding the jaws 2*a*, 2*b* together while allowing them to be brought closer together or further apart within a predefined range.

The blind rivet 4 in the pre-set condition is inserted by the head 42 into the oval-outline orifice 52 to exit via the orifice 60. The blind rivet 4 is inserted using slight force through the washer 28. The connector is then in a ready-to-use condition.

In the ready-to-use condition, the jaws 2*a*, 2*b* can be brought closer together or further apart with the blind rivet 4 that remains in place.

The body 44 of the shank 43 is configured to extend beyond the washer 28 when the jaws 2*a*, 2*b* are apart by the greatest thickness provided for the cables 3 and the head 45 abuts the end face 27 of the jaw 2*a*. In the position of maximum distance between the jaws 2*a* and 2*b*, set by the abutment of the lugs 50 against the base of the opening delimited by the corresponding wall 51, the shank 43 is still in contact with the washer 28.

In order to make the connection between the cables 3 with the connector 1, the cables 3 are inserted laterally into the cable grooves 32.

Depending on the diameter of the cables 3 and if desired, it is possible to bring the two jaws 2*a*, 2*b* closer together manually in order to place the respective active parts 22 in contact with the cables 3. The connector 1 is then in the cable installation position (FIG. 4).

In the in-service position (FIG. 5), the jaws 2*a*, 2*b* are held against the cables 3 by the blind rivet 4 in its set condition, the head 45 of the shank 43 being engaged on the end face 27 of the first jaw 2*a* and the bead 47 being engaged on the outer face of the washer 28. The cables 3 are sandwiched between the jaws 2*a*, 2*b*. The active parts 22 are inserted into the conductive core 30 of the electric cables 3, through the insulating sheath 31, thus ensuring that the cables 3 are electrically connected.

In order to pass from the cable installation position to the in-service position, the blind rivet 4 is set using rivet pliers (not shown). The rivet pliers are of a standard type comprising a nosepiece. The nosepiece is placed around the body 41 of the mandrel 40. It is mobile with respect to a stop that rests on the head 45 of the shank 43. By operating the rivet pliers, the body 41 is subjected via the nosepiece to a tensile force or a series of tensile forces, thus bringing the blind rivet 4 from the pre-set condition to the set condition.

During the transition between the pre-set condition and the set condition, successively:

- the head 42 of the mandrel 40 locally deforms the body 44 of the shank 43; the bead 47 appears,
- the bead 47 becomes engaged on the rim of the engagement orifice 61 of the washer 28 and the head 45 of the shank 43 becomes engaged on the end face 27 of the first jaw 2*a*,
- the two jaws 2*a*, 2*b* are brought closer together,
- the active parts 22 penetrate the insulating sheath 31 then the conductive core 30 of the cables, the tightening resistance increasing as the active parts 22 penetrate the cables 3, and
- the body 41 of the mandrel 40 breaks when the tightening resistance reaches a determined threshold corresponding to the desired penetration depth.

The penetration depth of the active parts 22 into the conductive core 30 of the cables is critical for the quality of the electrical connection between the cables 3 and to preserve the integrity of the cables 3. The blind rivet 4 is therefore chosen to reach its set condition when the desired penetration depth is reached.

When the blind rivet 4 is in the pre-set condition, the shank 43 has an initial length that is greater than the sum of the thickness of the first jaw 2*a*, the thickness of the cables 3, the thickness of the second jaw 2*b* and the height of the head 42 of the mandrel 40.

By the thickness of the first jaw 2*a* is meant herein the distance in the direction of the blind rivet 4, between the edge of the oval-outline orifice 52 and the end of an active part 22 of the first jaw 2*a* in contact with one of the cables 3; and by the thickness of the second jaw 2*b* is meant the distance, in the direction of the blind rivet 4, between the engagement orifice 61 and the end of an active part of the second jaw 2*b* in contact with one of the cables 3.

In order to achieve the set condition, the blind rivet must contract by a length equal to the sum of the flattening of the cables 3 under the effect of their clamping between the jaws 2*a* and 2*b*, the penetration depth of the active parts 22 of the first jaw 2*a* into the cables 3, the penetration depth of the active parts 22 of the second jaw 2*b* into the cables 3 and the engagement depth of the head 42 of the mandrel 40 in the body 44 of the shank 43.

Once the mandrel 40 has broken, the blind rivet 4 is in the set condition and the connector 1 is in the in-service position. The cradles 54*a*, 54*b*, 54*c* and 54*d* then cover the active parts 22 around their respective point of penetration into the cables 3. The active parts 22 are then on the one hand isolated from any dampness present in the environment of the connector 1, and on the other hand electrically insulated from the outside of the connector.

It must be noted that the diameter of the bore 33 of the hole 24 in the second jaw 2*b* is greater than the outside diameter of the body 44 of the shank 43 of the blind rivet 4 in the pre-set condition. Thus, when the blind rivet 4 passes into the set condition, the body 44 increases in width in the bore 33 or in the gap between the jaws 2*a*, 2*b*.

It will be noted that the hole 24 in the jaw 2*a* extends while becoming wider until opening onto the end face 27 via the oval-outline orifice 52. This flared form is provided so that the jaw 2*a* slopes in a configuration where the electric cables 3 have different diameters. In such an implementation (not shown), the head 45 of the shank 43 engages on the rim of one end of the oval-outline orifice 52.

In the example shown, the connector 1 is provided for cables 3 each having a cross-section comprised between 1.5 $mm^2$ and 25 $mm^2$. The body 41 of the mandrel 40 is designed, for example using a calibrated frangible zone, to break under a tensile force comprised between 4,500 N and 6,500 N. Such a rivet is for example a rivet the shank 43 of which is made of aluminium with the body having an outside diameter of the order of 4.8 mm. The stroke described by the jaws as they are brought towards each other from the cable installation position (FIG. 4) to the in-service position (FIG. 5) is typically of the order of 11 mm.

The fact that the tensile force is at least equal to 4,500 N makes it possible to ensure that the jaws have sufficiently penetrated the cables. The fact that the tensile force is at most equal to 6,500 N makes it possible to ensure that the jaws have not penetrated the cables too deeply.

In another version, the connector 1 is provided so that one of the cables 3 has a cross-section comprised between 16 $mm^2$ and 95 $mm^2$ and so that the other cable 3 has a cross-section comprised between 4 $mm^2$ and 35 $mm^2$. The body 41 of the mandrel 40 is designed, for example using a calibrated frangible zone, to break under a tensile force comprised between 8,500 N and 10,500 N. Such a rivet is for example a rivet the shank 43 of which is made of aluminium with the body having an outside diameter of the order of 5.3 mm. The stroke described by the jaws as they are brought towards each other from the cable installation position (FIG. 4) to the in-service position (FIG. 5) is typically of the order of 13 mm.

In another version, the connector 1 is provided for cables 3 each having a cross-section comprised between 16 $mm^2$ and 95 $mm^2$. The body 41 of the mandrel 40 is designed, for example using a calibrated frangible zone, to break under a tensile force comprised between 11000 N and 13000 N. Such a rivet is for example a rivet the shank 43 of which is made of aluminium with the body having an outside diameter of the order of 6.3 mm. The stroke described by the jaws as they are brought towards each other from the cable installation position (FIG. 4) to the in-service position (FIG. 5) is typically of the order of 13 mm.

In a variant (not shown), the jaws 2*a*, 2*b* of the connector do not contain a sealing gasket 23 and/or the number of contact elements 21 is different from two, for example a single one or more than two.

In another variant (not shown), in the ready-to-use condition the body 44 of the shank 43 is preset on assembly, i.e. the bead 47 has been begun. The rivet 4 is thus captive. In another variant, the captive means are different, for example a clipping tab on the jaw 2*b* and a cavity arranged externally in the body 44 of the shank 43 to receive the clipping tab.

It will be noted that the washer 28 constitutes a reinforcing element allowing the bead 47 to engage on the jaw 2*b*. In a variant, the reinforcing element is different from the washer 28, with for example a greater thickness at the centre (around the engagement orifice 61) than around the edge.

In a variant (not shown), the lateral faces 26*a*, 26*b* of the two jaws 2*a*, 2*b* have neither lug nor stirrup.

Many other variants are possible depending on the circumstances, and it is noted in this respect that the invention is not limited to the examples described and shown.

The invention claimed is:

1. Connector for connecting two electric cables (3) together, comprising two jaws (2*a*, 2*b*) and a tightening element (4) for bringing said jaws (2*a*, 2*b*) closer together, each said jaw (2*a*, 2*b*) comprising a body (20) made of stiff insulating material and a conductive contact element (21) having two active parts (22) each projecting from a receiving face (25) of the body (20) in order to penetrate the conductive core (30) of a cable (3) and the conductive core (30) of the other cable (3) respectively, the receiving face (25) of the body (20) of each jaw (2*a*, 2*b*) facing the receiving face (25) of the body (20) of the other jaw (2*a*, 2*b*) with each active part (22) of the contact element (21) of one jaw (2*a*, 2*b*) in line with an active part (22) of the contact element (21) of the other jaw (2*a*, 2*b*), said connector being configured to adopt a cable installation position between the receiving faces (25) of the jaws (2*a*, 2*b*) with each active part (22) of a contact element (21) in line with a cable (3), to adopt an in-service position in which the cables (3) are sandwiched between the jaws (2*a*, 2*b*) with each active part (22) of each contact element (21) having penetrated a conductive core (30) of a respective cable (3), and to pass from the cable installation position to the in-service position by bringing the jaws (2*a*, 2*b*) closer together, with the tightening element (4), by a predetermined stroke;

characterized in that said tightening element (4) is a blind rivet (4) comprising a shank (43) and a mandrel (40), said blind rivet (4) being configured so that the shank (43) contracts in the axial direction, under the action of the mandrel (40), between the cable installation position and the in-service position, and configured so that the mandrel (40) breaks when said jaws (2*a*, 2*b*) are brought closer together by said predetermined stroke.

2. Connector according to claim 1, characterized in that said shank (43) comprises a head (45) facing an end face (27) of a first said jaw (2*a*) while said mandrel (40) has a head (42) on the side of the end of said shank (43) opposite said head (45), with said shank (43) that comprises a body (44) engaged in a hole (24) in the first jaw (2*a*) extending from said end face (27) to said receiving face (25) and in a hole (24) in said second jaw (2*b*) extending from said receiving face (25) to an end face (27) opposite the receiving face, said body (44) emerging from said second jaw (2*b*) through an engagement orifice (61) for a bead (47) presented by said shank (43) in said in-service position.

3. Connector according to claim 2, characterized in that said engagement orifice (61) is delimited by a reinforcing element (28) attached to the body (20) of said second jaw (2*b*).

4. Connector according to claim 3, characterized in that said reinforcing element (28) is a metal washer engaged in the base of a countersink (29) of said hole (24) in said second jaw (2*b*).

5. Connector according to claim 2, characterized in that, in said cable installation position, at least one portion (33) of said hole (24) in said second jaw (2*b*) has a greater diameter than the diameter of the body (44) of the shank (43) to allow said body (44) to increase in width in said portion (33) when passing from the cable installation position to the in-service position.

6. Connector according to claim 1, characterized in that it comprises, in a ready-to-use condition, captive means of said rivet (4).

7. Connector according to claim 6, characterized in that said captive means are forms by a bead (47) of said body (44) of said shank (43), begun by said head (42) of said mandrel (40).

8. Connector according to claim 1, characterized in that it is configured so that said two electric cables (3) each have a cross-section comprised between 1.5 $mm^2$ and 25 $mm^2$ with said mandrel (40) configured to break when it is subjected to a tensile force comprised between 4,500 N and 6,500 N.

9. Connector according to claim 1, characterized in that it is configured so that said two electric cables (3) each have a cross-section comprised between 16 $mm^2$ and 95 $mm^2$ with said mandrel (40) configured to break when it is subjected to a tensile force comprised between 11,000 N and 13,000 N.

10. Connector according to claim 1, characterized in that it is configured so that a first one of said two electric cables (3) has a cross-section comprised between 16 $mm^2$ and 95 $mm^2$ and the second of said two cables has a cross-section comprised between 4 $mm^2$ and 35 $mm^2$ with said mandrel (40) configured to break when it is subjected to a tensile force comprised between 8,500 N and 10,500 N.

11. Connector according to claim 3, characterized in that, in said cable installation position, at least one portion (33) of said hole (24) in said second jaw (2*b*) has a greater diameter than the diameter of the body (44) of the shank (43) to allow said body (44) to increase in width in said portion (33) when passing from the cable installation position to the in-service position.

12. Connector according to claim 4, characterized in that, in said cable installation position, at least one portion (33) of said hole (24) in said second jaw (2*b*) has a greater diameter than the diameter of the body (44) of the shank (43) to allow said body (44) to increase in width in said portion (33) when passing from the cable installation position to the in-service position.

* * * * *